US005507494A

United States Patent [19]

De Bono

[11] Patent Number: 5,507,494

[45] Date of Patent: Apr. 16, 1996

[54] THREE SPOT GAME

[76] Inventor: Edward De Bono, L2 Albany, Piccadilly, London, W1V 9RR, England

[21] Appl. No.: 513,050

[22] Filed: Aug. 9, 1995

[51] Int. Cl.[6] ..... A63F 3/00

[52] U.S. Cl. ..... 273/236

[58] Field of Search ..... 273/236, 242, 273/258, 264, 268, 271

[56] References Cited

U.S. PATENT DOCUMENTS

| | | | |
|---|---|---|---|
| 1,465,160 | 8/1923 | Di Luchio | 273/264 |
| 4,102,535 | 7/1978 | Kindred | 273/271 X |
| 4,213,616 | 7/1980 | Dickey | 273/271 |
| 4,456,261 | 6/1984 | Daitzman | 273/271 |
| 4,687,207 | 8/1987 | Darling | 273/271 |
| 4,706,961 | 11/1987 | Singleman et al. | 273/271 X |
| 4,813,681 | 3/1989 | Volpert, Jr. | 273/271 |
| 5,007,648 | 4/1991 | Polan | 273/236 |
| 5,248,149 | 9/1993 | Tarrats | 273/271 |

*Primary Examiner*—William E. Stoll
*Attorney, Agent, or Firm*—Michael Ebert

[57] ABSTRACT

A game for two players which makes use of three playing pieces and a board whose face presents an array of nine like squares, a scoring spot being contained in each of the three squares at one end of the array, the other six squares being blank. The three playing pieces are each in the form of a rectangular chip having a size corresponding to that of a pair of adjacent squares, so that in the course of play, each piece can be placed on the board to occupy any pair of adjacent square in the array in the X or Y direction. One piece is white and serves as a neutral piece, while the other two pieces have different colors, each player selecting for play a respective colored piece.

6 Claims, 2 Drawing Sheets

THREE SPOT GAME

BACKGROUND OF INVENTION

1. Field of Invention

This invention relates generally to games for two players which make use of a board and playing pieces which in the course of play are moved on the board, and more particularly, to a game in which the face of the board presents an array of nine like squares on which is movable three playing pieces.

2. Status of Prior Art

Many games are known for two players which make use of a playing board divided into squares and playing pieces which are movable by the players to occupy different squares on the board. Thus checkers is a game which employs a square board divided into 64 alternately colored squares, each player being provided with a set of 12 pieces in the form of colored discs. A chess game uses the same board as in checkers, each player being provided with a set of 16 chessmen, the pieces in one set being all white and those in the other set being all black.

A three-spot game for two players in accordance with the invention is simpler in its equipment than either checkers or chess, for it uses only three playing pieces and a board whose face presents an array of nine squares. Yet this simple equipment lends itself to complex game strategies that require a high order of skill to execute, for the winner of a three spot game is not always the, player who scores the highest number of points. Should the opposing player score, less than a predetermined number of point, then he is the winner.

Indeed, a three spot game in some respects violates the theory of games first developed by John Von Neumann. Under this theory, a game consists of a set of rules governing a competitive situation in which two or more players choose strategies calculated to maximize their own winnings and minimize those of the opponents. These rules specify the possible action each player can take and the amount won or lost in various situations. Hence the winner of a game in all cases is the player who scores the highest number of points.

In contradistinction to the theory of games, a three spot game in accordance with the invention calls for strategies calculated to force an opposing player to also gain points, so that when a player scores the predetermined number of points which marks the end of the game, the opposing player has then scored a lesser number of points, but a sufficient number to avoid being declared the winner. Hence one possible game strategy is for a player is to score the fewest possible number of points in order to win the game.

SUMMARY OF INVENTION

In view of the foregoing, the main object of this invention is to provide a game for two players which makes use of a board whose face presents an array of nine like squares and three playing pieces which are movable on the board to occupy any pair of adjacent squares thereon.

More particularly an object of this invention is to provide a game of the above type in which the three squares at one end of the array each contain a scoring spot therein, the other six squares being blank, scoring being effected by counting the number of spot squares covered by the playing pieces.

A significant feature of the invention is that the winner of the game is either the player who at the end of the game reaches a score that is greater than the score reached by the opposing player, but only if the opposing player's score is greater than a predetermined number, or the player whose score is less than the predetermined number. Hence a game in accordance with the invention dictates complex play strategies, some of which are calculated to reduce the number of points scored rather than to increase this number.

Briefly stated, a game in accordance with the invention which makes use of three playing pieces and a board whose face presents an array of nine like squares, a scoring spot being contained in each of the three squares at one end of the array, the other six squares being blank. The three playing pieces are each in the form of a rectangular chip having a size corresponding to that of a pair of adjacent squares, so that in the course of play each piece can be placed on the board to occupy any pair of adjacent square in the array in the X or Y direction. One piece is white and serves as a neutral piece, while the other two pieces have different colors, each player selecting for play a respective colored piece.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
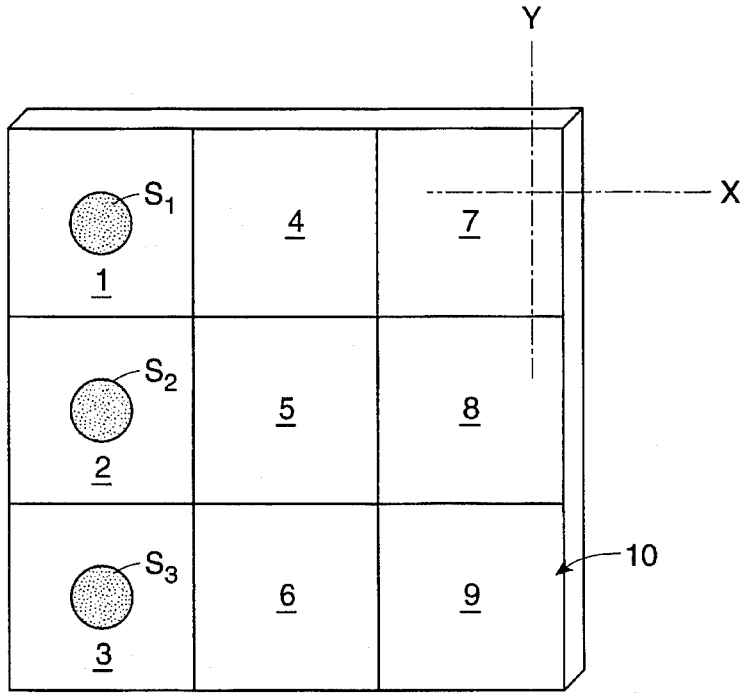
FIG. 1 illustrates the board used in the game in accordance with the invention.

The Game Apparatus:

In a three spot game for two players in accordance with the invention, use is made, as shown in FIG. 1, of a square board 10. The face of board 10 is divided by vertical lines in the Y direction and intersecting horizontal lines in the X direction to create an array of nine like squares 1 to 9. The vertical row of squares 1 to 3 at the left side of the array each contains at its center a round dot. Hence there is a dot $S_1$ in square 1, a dot $S_2$ in square 2 and a dot $S_3$ in square 3. The six squares 4 to 9 are blank.

Figure 2:
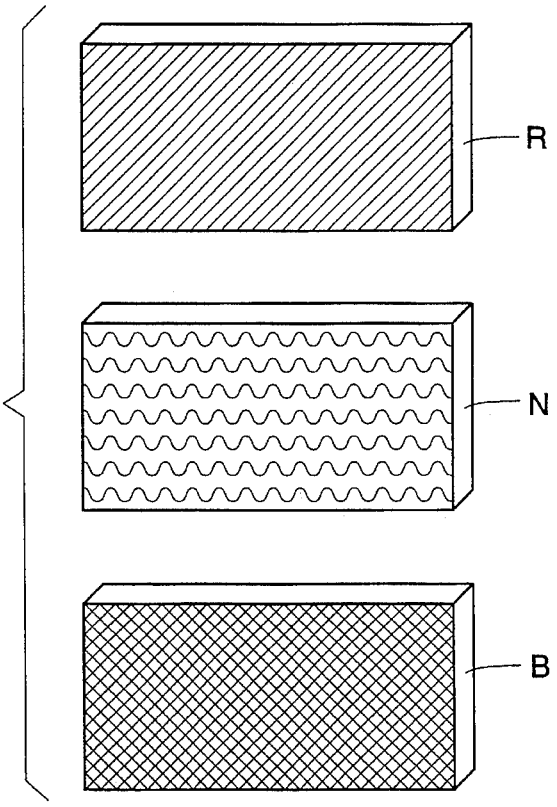
FIG. 2 shows the three playing pieces used in the game.

Also provided are three playing pieces as shown in FIG. 2, which are each formed of a rectangular plastic chips whose size corresponds to that of a pair of adjacent squares in the array on board 10. One piece R has a red color, the second piece N has a white colored and the third piece B has a blue color. Piece N is a neutral piece, whereas color pieces R and B are selected for play by the respective players, so that one player plays with a blue piece and the other with a red piece.

The invention is not limited to these particular colors, for in practice the neutral piece may be black and the other two pieces may be green and yellow.

Because each piece is equal in size for a pair of adjacent squares, the piece may be placed anywhere on the board to occupy any pair of adjacent squares in the X or Y direction.

Thus one may place a piece to overlie the pair of squares 1 and 4 in the X direction, or to overlie the pair of squares 7 and 8 in the Y direction.

Figure 3:
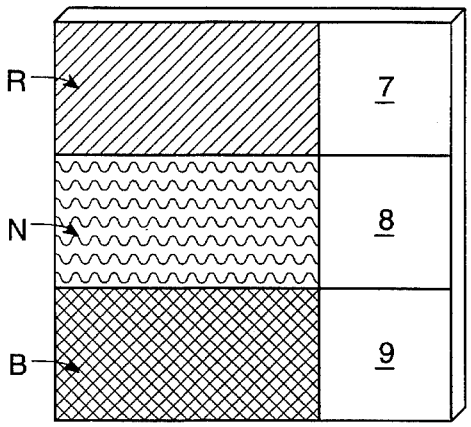
FIG. 3 illustrates the position of the playing pieces on the board at the start of the game.

Play:

At the start of the same, the pieces are placed on the board, as shown in FIG. 3 so that red piece R occupies square 1 and 4, neutral white piece N occupies squares 2 and 5 and blue piece B occupies squares 3 and 6. Hence at the start of the game all spot squares 1, 2 and 3 are covered.

One player plays with the R piece and the other with the B piece. The starting player moves his pieces to a "new position," this being a position in which the piece does not cover exactly the same pair of adjacent squares on the board as before. To do this, the piece is lifted off the board and placed anywhere else on the board at a site chosen by the player.

After a player has moved his piece to a new position, he must then move the neutral piece N to a new position. Thus to complete a play turn, the player must first move his piece to a new position and then move the neutral piece to a new position. At the end of the turn, the player score one point for every spot square on the board covered by his play piece. But the player does not score the spot squares covered by the neutral piece N. If, therefore, at the end of a particular turn, a player's piece B covers spots $S_1$ and $S_2$ and neutral piece N covers spot $S_3$ the player's score for this play turn is 2 points, not three.

The opposing player then makes his move in the same way by placing his pieces on the board at a new position, and then placing the neutral piece at a new position, at which point the number of spots covered by the opposing player's piece is scored.

The game is concluded when one of the players reach a maximum score of 12 points. The number of play turns it takes to reach this score depends on the strategy employed by this player. The declared winner at the conclusion of the game is the player who scored 12 points, but only if the opposing player has reached a minimum score of 6 points or more. If, therefore, at the conclusion of the game in which one player has reached 12 points and the opposing player has reached 8 points, then the former wins the game. However, if the opposing player has only reached 5 points, then he is the winner of the game.

Strategies:

Because in a three spot game, in accordance with the invention a player who charges ahead to score as many points as he can in any play turn of the game, he may succeed in losing, if this strategy leads to the opposing player scoring so few points as to win. As a result, each player has to keep switching strategies from scoring as many points as he can, to forcing the opponent to score points, or to avoid scoring points.

The need to switch strategies in the course of play compels the player to assess his opponent's strategy and to determine when to switch strategies. The player, therefore, must plan ahead to the score, to be made after the next one, and recognize the importance of the neutral piece N.

For any given set up on the board, the best play depends on which strategy is being executed, bearing in mind that the player who appears to be losing the game may still have a good chance of winning if he is prevented by the other player from scoring too many points.

Figure 4:
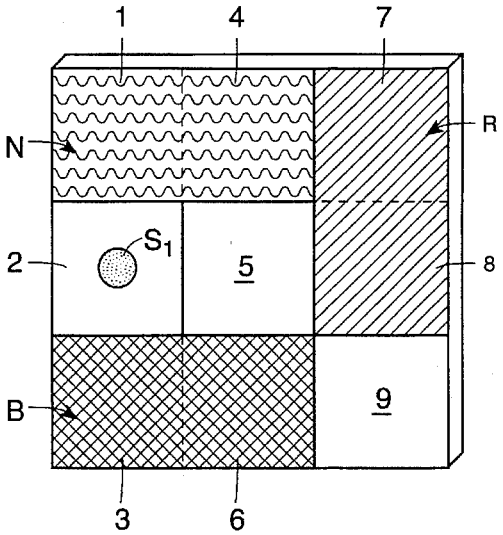
FIG. 4 shows the playing pieces on the board at one point in the game.

This at any play turn in the three spot game, the best play is determined by the strategy at that moment. FIG. 4 shows the playing position at one point in the game in which neutral piece N covers squares 1 and 4, red piece R covers squares 7 and 8 and blue piece B covers squares 3 and 6, the red piece R being the next to move.

Figure 5:
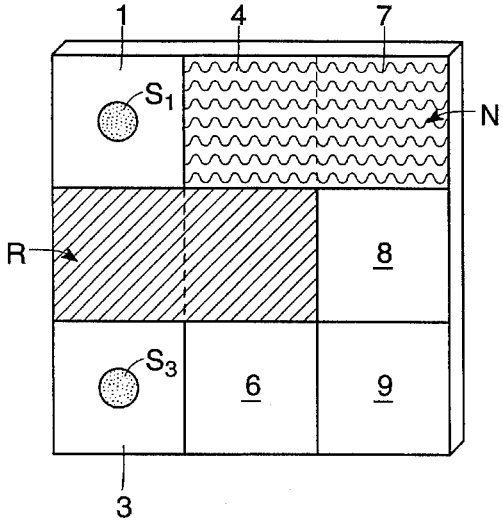
FIG. 5 shows another possible play position for the pieces.

If red piece R is trying to score points, then the next move, as shown in FIG. 5, is one in which red piece R is placed over squares 2 and 5 to immediately score one point and the neutral piece is placed over squares 4 and 7. In this position the red piece may be able to score two points on the next move.

Figure 6:
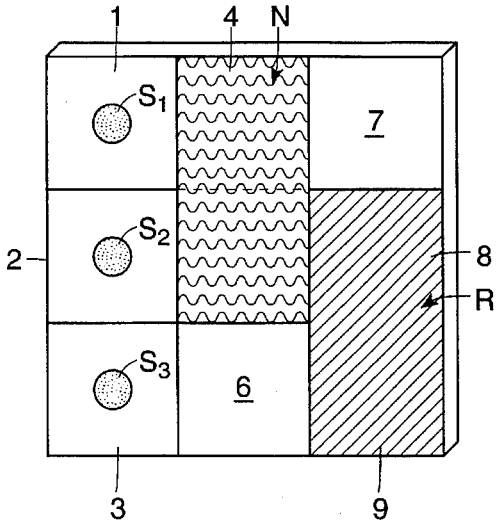
FIG. 6 shows still another play position.

But if the red piece player is trying to force the blue piece player to score points, then as shown in FIG. 6, red piece R is placed to cover squares 8 and 9, and neutral piece N is placed to cover squares 4 and 5, thereby scoring no points but exposing spot squares 1, 2 and 3. This arrangement gives the blue piece player no choice but to score 2 points on his next move.

Hence while the three spot game involves only three playing pieces on a board having an array of 9 squares, it is not a game that is quickly mastered, for a novice player though he knows how to move the pieces, must develop strategies to reach the winning goal by scoring 12 points while his opponent scores at least 6 points, or to reach this goal by scoring less than six points. Hence a player may at some junction in the game decide that the best course of action is to reduce, if he can, the number of points being scored.

While there has been shown a preferred embodiment of a three spot game in accordance with the invention, it will be appreciated that many changes may be made therein without departing from the spirit of the invention.

I claim:

1. A game apparatus for two players comprising:

A. a board whose face presents an array of nine like squares, each square on one side of the array having a scoring spot thereon, the other squares in the array being blank; and B. three rectangular playing pieces each having a size corresponding to a pair of adjacent squares in the array, whereby in the course of play each playing piece may be placed to overlie a pair of adjacent squares in either the X or Y direction in the array.

2. A game apparatus as set forth in claim 1, in which the pieces are formed by plastic chips.

3. A game apparatus as set forth in claim 1, in which one of the playing pieces is a neutral piece, and the other two pieces have different colors one of which is chosen, for play by one player, the other being chosen by the opposing player.

4. A method of playing a game with apparatus as set forth in claim 3, in which each player takes turn to move his chosen piece to a new position on the board to occupy a pair of adjacent squares thereon, and to then move the new piece to a neutral position, the player at the end of his play turn scoring a point for each spot square covered by his chosen playing piece.

5. A method as set forth in claim 4, wherein when with repeated turns one player gains a predetermined maximum number of points and the opposing player gains at least a predetermined minimum number of points, then the one player is the winner, but if the points gained by the opposing player is below the minimum number, he then is the winner.

6. A method as set forth in claim 5, in which the maximum number is 12 and the minimum number is 6.

* * * * *